US007371116B2

(12) United States Patent
Chiang

(10) Patent No.: US 7,371,116 B2
(45) Date of Patent: May 13, 2008

(54) CONNECTOR SOCKET FOR ESATA AND USB PLUGS

(75) Inventor: Jui-Tu Chiang, Taipei Hsien (TW)

(73) Assignee: Taiwan Electronics Co., Ltd., Taipei Hsien (TW)

( * ) Notice: Subject to any disclaimer, the term of this patent is extended or adjusted under 35 U.S.C. 154(b) by 0 days.

(21) Appl. No.: 11/653,126

(22) Filed: Jan. 12, 2007

(65) Prior Publication Data

US 2007/0173121 A1 Jul. 26, 2007

(30) Foreign Application Priority Data

Jan. 24, 2006 (TW) ..... 95201553 U

(51) Int. Cl.
*H01R 13/648* (2006.01)

(52) U.S. Cl. ..... 439/607

(58) Field of Classification Search ..... 439/607, 439/609

See application file for complete search history.

(56) References Cited

U.S. PATENT DOCUMENTS 6,053,773 A * 4/2000 Wu ..... 439/609
7,097,507 B1 * 8/2006 Zhang et al. ..... 439/609

* cited by examiner

*Primary Examiner*—Ross Gushi
(74) *Attorney, Agent, or Firm*—Alan Kamrath; Kamrath & Associates PA

(57) ABSTRACT

A connector socket for external serial ATA (eSATA) and universal serial bud (USB) plugs has a casing, an eSATA contact set and a USB contact set. The casing has a cavity defined in the casing, an inner rear surface and a contact seat formed on and extending forward from the inner rear surface. The eSATA contact set is mounted on the contact seat and has multiple eSATA contacts being conductive and mounted on the contact seat. The USB contact set is mounted on the contact seat opposite to the eSATA contact set and has multiple USB contacts being conductive and mounted on the contact seat. The connector socket having the single contact seat is compact.

1 Claim, 5 Drawing Sheets

CONNECTOR SOCKET FOR ESATA AND USB PLUGS

BACKGROUND OF THE INVENTION

1. Field of the Invention

The present invention relates to a connector socket and, more particularly, to a connector socket that may receive external ATA (eSATA) or universal serial bus (USB) plugs and that is compact.

2. Description of Related Art

Computer periphery equipment such as flash drives, portable hard disc drives or external CD-ROM drives is connected with the computer through the universal serial bus (USB) connector socket or Institute of Electrical and Electronic Engineers 1394 (IEEE1394) protocol. The most popular connector socket is USB 2.0 at present. Almost all computers have the USB 2.0 connector socket, and the upper limitation of a data transmission speed of the USB 2.0 connector socket is as high as 480M bps.

With the development of portable peripheral equipment, the data transmission speed is higher and higher. The invention of the hard disc external box makes the hard disc drive portable, and the speed of USB 2.0 is not insufficient to support the high speed transmission between the hard disc external box and a computer. Therefore, a new connector socket, external serial ATA (eSATA), which has a data transmission speed up to 3G bps to satisfy the portable hard disc drive, has been developed recently. USB and eSATA connector sockets have similar structures, and each of them has a casing, a contact seat and multiple contacts. The casing has a cavity having an inner surface. The contact seat is formed on and extends forward from the inner surface of the cavity. The contacts are mounted on the contact seat. However, the USB and eSATA connector sockets are not compatible with other.

With regard to notebook computers, the USB connector socket is an essential element in almost notebook computers. Undoubtedly, the eSATA connector socket will be the next essential element on the notebook computers in the future.

However, incorporating the USB and eSATA connector sockets on a notebook computer occupies a mounting space in the notebook computer and would prohibit other elements such as an IEEE 1394 connector socket or an audio connector socket from being mounted on the notebook computer.

An improved connector socket is developed and has an eSATA interface and a USB interface stacked vertically. However, mounting such a connector socket into the notebook computer increases the thickness of the notebook computer, which makes the computer not compact and unmarketable.

To overcome the shortcomings, the present invention provides a connector socket for eSATA and USB plugs to mitigate or obviate the aforementioned problems.

SUMMARY OF THE INVENTION

The main objective of the invention is to provide a connector socket that may receive external ATA (eSATA) or universal serial bus (USB) plugs and is compact.

A connector socket for external serial ATA (eSATA) and universal serial bud (USB) plugs in accordance with the present invention comprises a casing, an eSATA contact set and a USB contact set. The casing has a cavity defined in the casing, an inner rear surface and a contact seat formed on and extending forward from the inner rear surface. The eSATA contact set is mounted on the contact seat and has multiple eSATA contacts being conductive and mounted on the contact seat. The USB contact set is mounted on the contact seat opposite to the eSATA contact set and has multiple USB contacts which are conductive and mounted on the contact seat.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
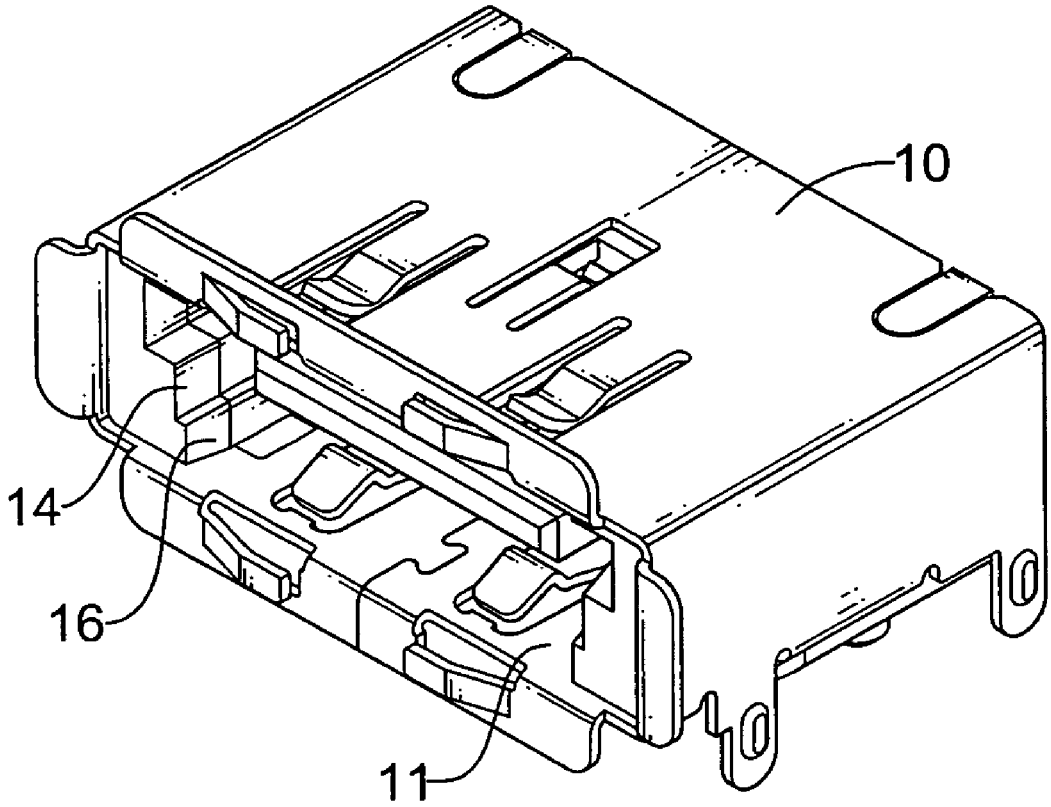
FIG. 1 is a perspective view of a connector socket for eSATA and USB plugs in accordance with the present invention.
Figure 2:
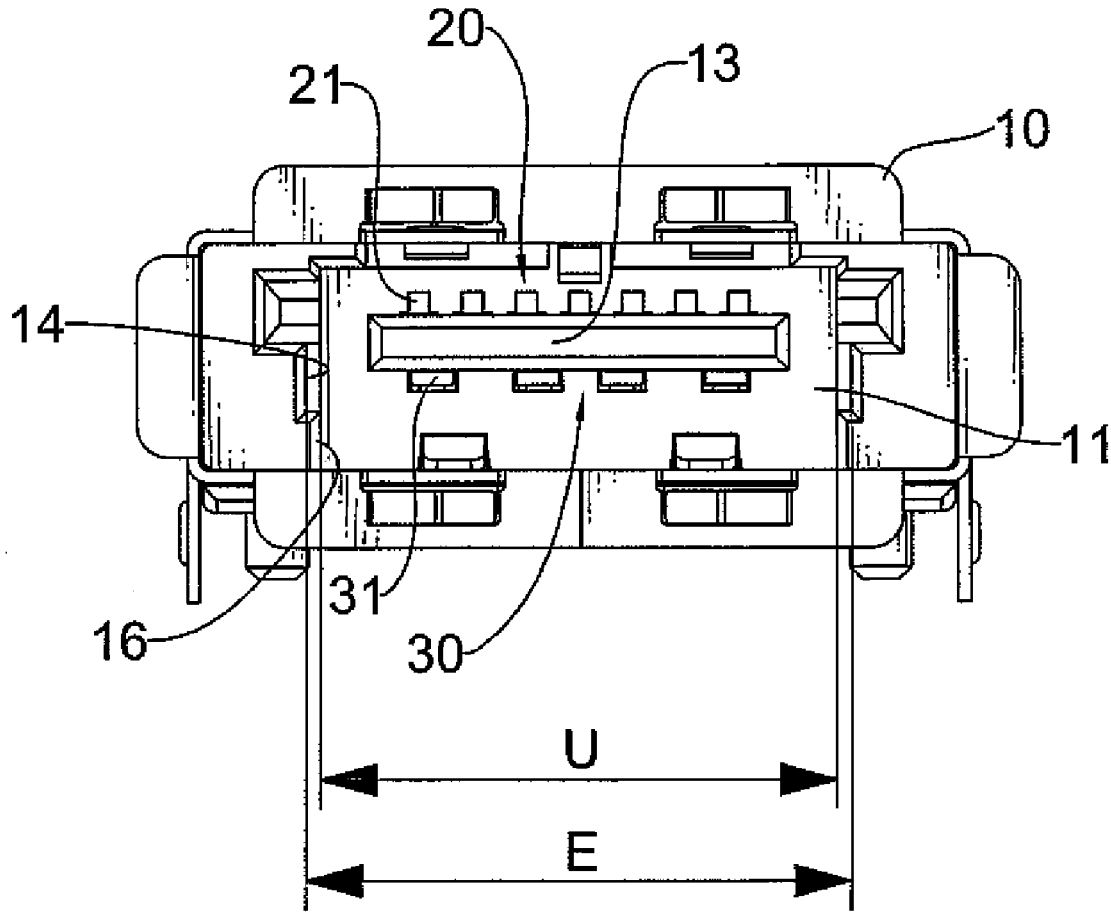
FIG. 2 is a front view of the connector socket in FIG. 1.
Figure 3:
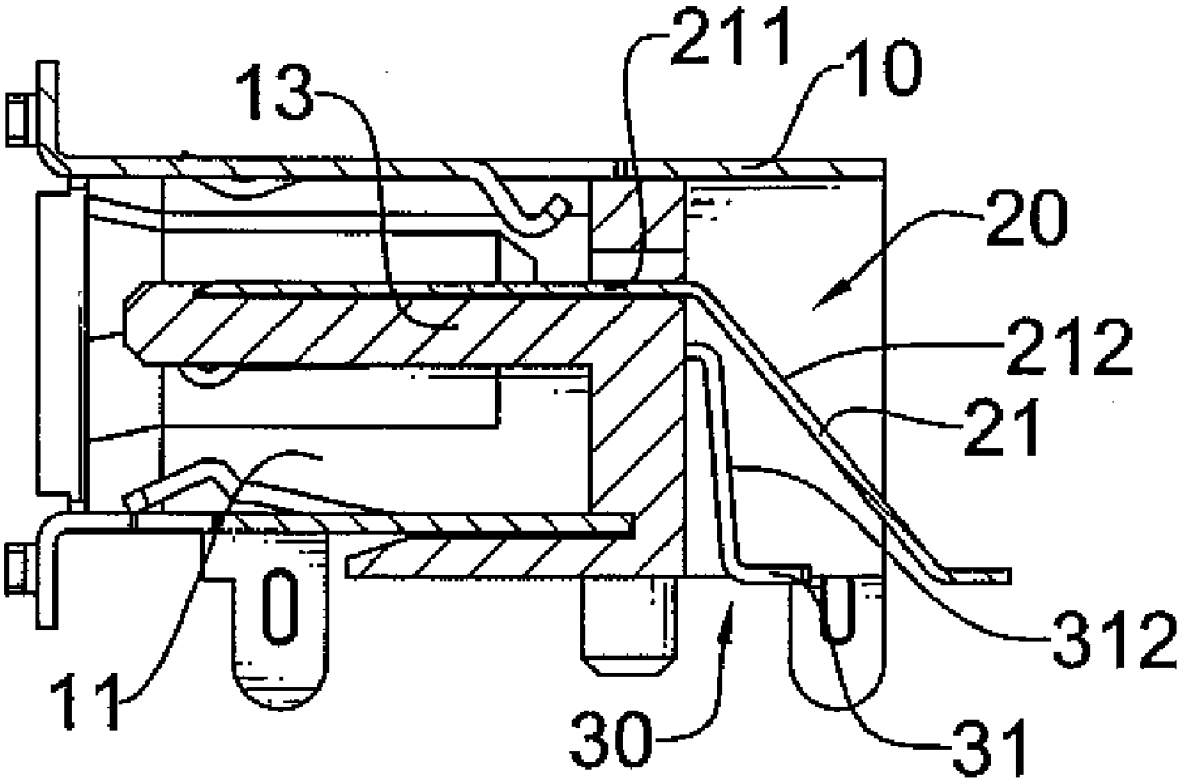
FIG. 3 is a cross sectional side view of the connector socket in FIG. 1.

With reference to FIGS. 1-3, a connector socket in accordance with the present invention may receive and hold an external serial ATA (eSATA) plug or a universal serial bus (USB) connector socket and comprises a casing (10), an eSATA contact set (20) and a USB contact set (30).

The casing (10) has a front, a cavity (11) and a contact seat (13). The cavity (11) is defined in the front and has a front opening and an inner rear surface. The front opening has an annular edge having stepped segments and forming an eSATA plug outline (14) and a USB plug outline (16). The eSATA plug outline (14) is rectangular, corresponds to and allows an eSATA plug to be mounted securely in the cavity (11) through the eSATA plug outline (14) and has a width (E). The USB plug outline (16) is rectangular, corresponds to and allows a USB plug to be mounted securely in the cavity (11) through the USB plug outline (16) and has a width (U) lesser than the width (E) of the eSATA plug outline (14). The contact seat (13) is formed on and extends forward from the inner rear surface of the cavity (11) and has a top surface and a bottom surface opposite to the top surface.

The eSATA contact set (20) is mounted on the contact seat (13) and has multiple eSATA contacts (21) which are conductive and mounted on the top surface of the contact seat (13). With further reference FIGS. 5 and 7, each eSATA contact (21) has a contacting section (211) and a soldering section (212). The contacting section (211) is mounted on the top surface of the contact seat (13) and has a rear end. The soldering section (212) is formed on and inclined down from the rear end of the contacting section (211). The soldering sections (212) of the eSATA contacts (21) are arranged in a row behind the contact seat (13).

The USB contact set (30) is mounted on the contact seat (13) opposite to the eSATA contact set (20) and has multiple USB contacts (31) which are conductive and mounted on the bottom surface of the contact seat (13). Each USB contact (31) has a contacting section (311) and a soldering section (312). The contacting section (311) is mounted on the bottom surface of the contact seat (13) and has a rear end. The soldering section (312) is formed on and inclined down from the rear end of the contacting section (211) and is located below and shorter the soldering section (312) of the eSATA contact (21). The soldering sections (312) of the USB contacts (31) are arranged in a row behind the contact seat (13) and closer to the contact seat (13) than the row of the soldering sections (212) of the eSATA contacts (21).

Figure 5:
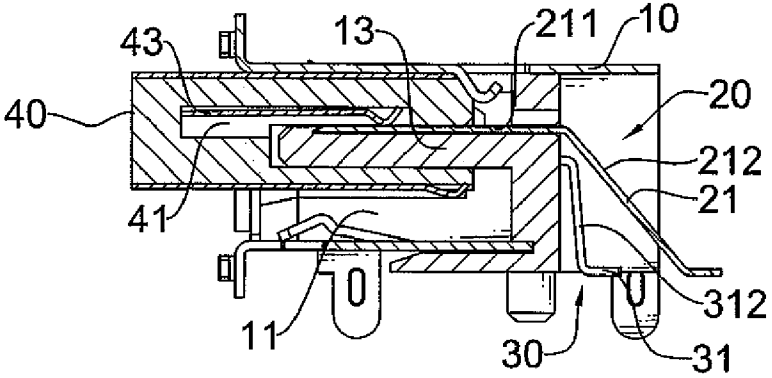
FIG. 5 is an operational cross sectional side view of the connector socket and the eSATA plug in FIG. 4.
Figure 4:
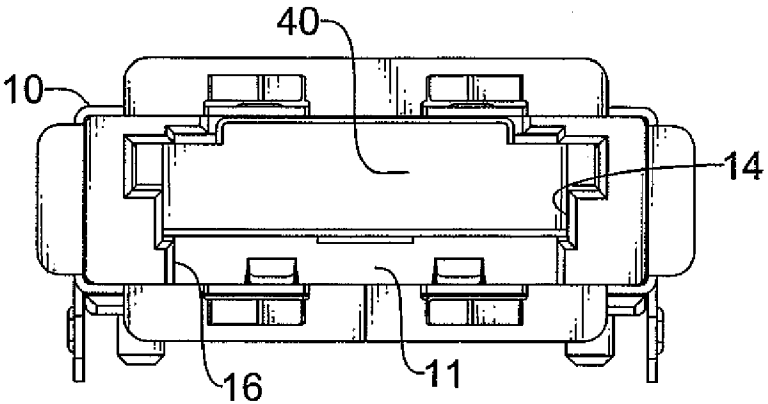
FIG. 4 is an operational front view of the connector socket receiving and holding an eSATA plug.

With reference to FIGS. 4 and 5, an eSATA plug (40) extends through the eSATA plug outline (14) and plugs in the cavity (11) in the connector socket. The eSATA plug (40) has a recess (41) and multiple contacts (43). The recess (41) is defined in the eSATA plug (40), has an inner surface and receives the contact seat (13) in the connector socket. The contacts (43) are mounted on the inner surface and respectively contact the eSATA contacts (21).

Figure 7:
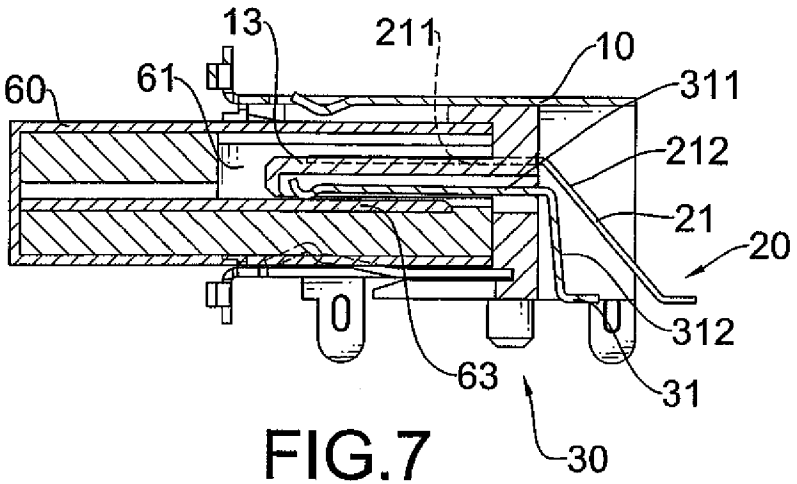
FIG. 7 is an operational front view of the connector socket and the USB plug in FIG. 6.
Figure 6:
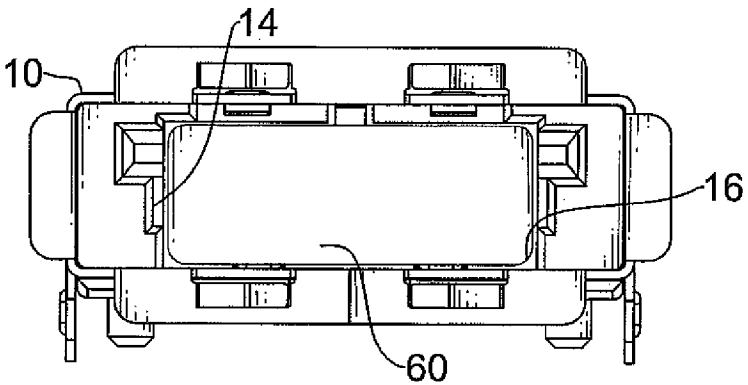
FIG. 6 is an operational front view of the connector socket receiving and holding a USB plug.

With reference to FIGS. 6 and 7, a USB plug (60) extends through the USB plug outline (16) and plugs in the cavity (11) in the connector socket. The USB plug (60) has a recess (61) and multiple contacts (63). The recess (61) is defined in the USB plug (60), has an inner surface and receives the contact seat (13) in the connector socket. The contacts (63) are mounted in the inner surface and respectively contact the USB contacts (31).

The connector socket with the single contact seat (13) has a thickness less than a sum of thicknesses of a conventional eSATA plug and a conventional USB plug. Therefore, the connector socket is compact and would not excessively increase a thickness of a notebook computer when the connector socket is mounted on the notebook computer.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A connector socket for external serial ATA (eSATA) and universal serial bus (USB) plugs comprising:

a casing having a cavity defined in the casing and having a front opening having an annular edge having stepped segments and forming an eSATA plug outline adapted to correspond to an eSATA plug and a USB plug outline adapted to correspond to a USB plug, wherein a width of the USB plug outline is lesser than a width of the eSATA plug outline;

an inner rear surface; and a contact seat formed on and extending forward from the inner rear surface, wherein the contact seat has a top surface and a bottom surface opposite to the top surface;

an eSATA contact set mounted on the contact seat and having multiple eSATA contacts being conductive and mounted on the top surface of the contact seat, and each eSATA contact having a contactintg section mounted on the top surface of the contact seat and having a rear end; and a solder section formed on and inclined down from the rear end of the contacting section, wherein the soldering sections of the eSATA contacts are arranged in a row behind the contact seat; and a USB contact set mounted on the contact seat opposite to the eSATA contact set and having multiple USB contacts being conductive and mounted on the bottom surface of the contact seat, and each USB contact having a contacting section mounted on the bottom surface of the contact seat and having a rear end; and a soldering section formed on and inclined down from the rear end of the contacting section and located below and shorter the soldering section of the eSATA contact, wherein the soldering sections of the USB contacts are arranged in a row behind the contact seat and closer to the contact seat than the row of the soldering sections of the eSATA contacts.

* * * * *

UNITED STATES PATENT AND TRADEMARK OFFICE

CERTIFICATE OF CORRECTION

PATENT NO. : 7,371,116 B2
APPLICATION NO. : 11/653126
DATED : May 13, 2008
INVENTOR(S) : Jui-Tu Chiang It is certified that error appears in the above-identified patent and that said Letters Patent is hereby corrected as shown below:

Title page, item (73), cancel "Taiwan" and substitute therefore --Taiwin--.

Signed and Sealed this

Twelfth Day of August, 2008

JON W. DUDAS
*Director of the United States Patent and Trademark Office*